United States Patent [19]

Molat

[11] 4,384,720

[45] May 24, 1983

[54] CHANGEABLE CIRCUIT CONTROLLING SWITCH ASSEMBLY

[76] Inventor: Joseph H. Molat, Stratford 36C, West Palm Beach, Fla. 33409

[21] Appl. No.: 165,227

[22] Filed: Jul. 1, 1980

[51] Int. Cl.[3] ..... A63F 3/00

[52] U.S. Cl. ..... 273/237

[58] Field of Search ..... 273/236, 238, 269; 40/464; 200/46, 309, 61.7

[56] References Cited

U.S. PATENT DOCUMENTS

| | | | |
|---|---|---|---|
| 1,651,275 | 11/1927 | Hirsch | 200/46 |
| 2,294,416 | 9/1942 | Mentzer | 200/46 |
| 2,760,619 | 8/1956 | Peak | 273/238 |
| 3,152,247 | 10/1964 | Brown | 200/46 |
| 3,160,731 | 12/1964 | Gemmell | 200/309 |
| 4,217,473 | 8/1980 | Parkinson | 200/46 |

*Primary Examiner*—Richard J. Apley
*Assistant Examiner*—R. C. Moy
*Attorney, Agent, or Firm*—Harvey B. Jacobson

[57] ABSTRACT

A display panel surface of a control board is divided into a plurality of zones at which manually operable switch devices are mounted to register zone selections by the user. The switch devices carry changeable zone identifying indicia of a type enabling use of the control board by sight handicapped persons.

8 Claims, 9 Drawing Figures

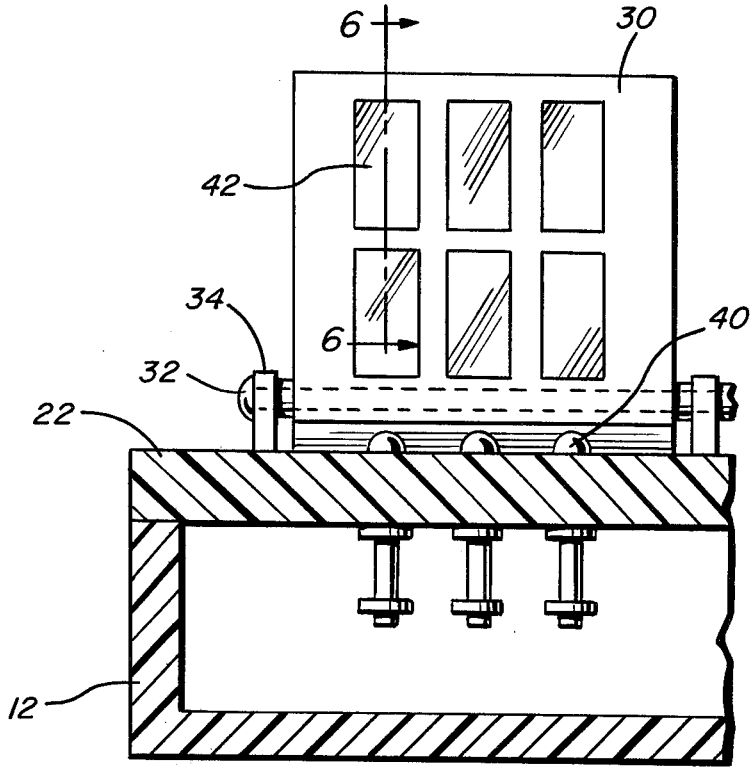
Fig. 5
Fig. 6
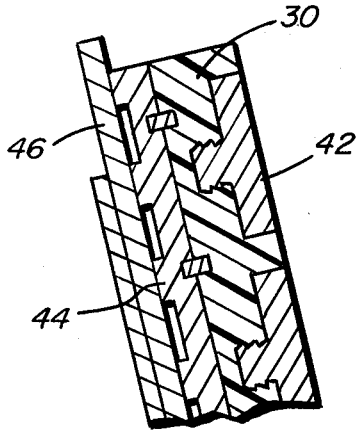
Fig. 7
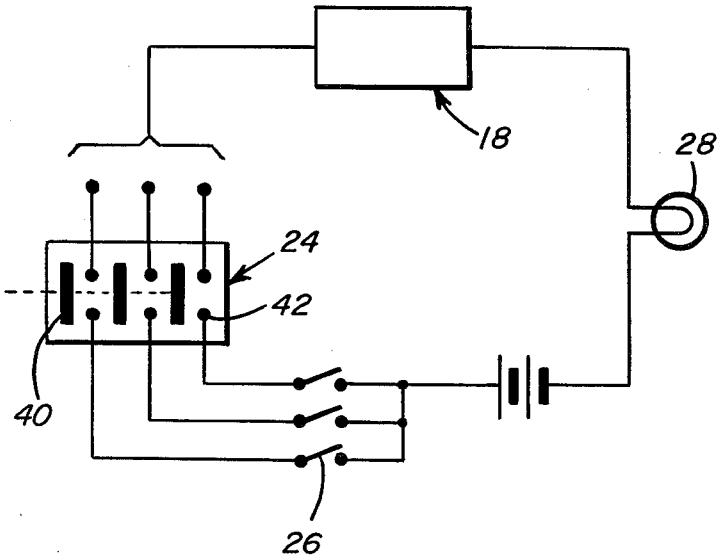

CHANGEABLE CIRCUIT CONTROLLING SWITCH ASSEMBLY

BACKGROUND OF THE INVENTION

This invention relates to programmed control board assemblies adaptable for use as game boards as well as for other uses, such as educational and security devices. Insofar as its recreational adaptations are concerned, the present invention is an improvement over the game board device disclosed in my prior copending application, Ser. No. 958,360, filed Nov. 3, 1978, with respect to which the present application is a continuation-in-part.

According to the disclosure in my prior copending application, a game board of the "Bingo" card type is provided wherein the board display panel is divided into a plurality of rectangular zones within which manually operable switches are mounted adjacent windows through which changeable zone identifying indicia are exposed. Groups of switches when actuated by a player in certain patterns establish conductive paths through a programmed circuit to energize an indicator signifying a winning game. Such a game board arrangement enables the playing of the game by sight handicapped persons through the manipulation of the manually operable switches on zones identified by indicia capable of being sensed through touch. The foregoing type of game board furthermore provides heightened interest to sighted players as well.

One of the drawbacks associated in the aforementioned game board is its constructional complexity and corresponding cost of manufacture. The costly manufacturing features reside in the zone indicia changing facilities and the zone identifying window arrangement. Other disadvantages reside in the necessity of separately displacing each zone registering switch to the inactive position in order to reset the game board. Additionally, repair and maintenance is costly because of the switch mounting arrangement.

It is therefore an important object of the present invention to provide a less costly programmed type of control assembly adaptable as a game board for both sighted and sight handicapped players. A further object is to provide such a programmed control assembly which is also adaptable for other varied uses.

Yet another object is to provide a programmed control board assembly that is easier to reset and change its program.

SUMMARY OF THE INVENTION

In its broadest aspect, the present invention resides in a control board that may be programmed for playing games such as "Bingo" by sight handicapped players or programmed for educational and instructive purposes, or for security purposes, such as automotive ignition and security lock operations. The control board includes a panel surface divided into a plurality of zones respectively occupied by manually operable switches. Each zone may mount replaceable zone identifying indicia which may be in the form of a numbers, letters or braille. Actuation of the switch registers selection of its zone as part of a game, or in answer to a question, or in accordance with a memorized code. The switches are interconnected through a circuit such as that disclosed in my prior copending application, aforementioned, to an audible or visual indicator that is energized whenever certain groups or patterns of zones are selected by actuation of their switches. The indicator will thereby signify a winning game, signify a correct or wrong answer, complete an ignition circuit, open a lock, or perform any other such control function.

Many different types of plural contact, miniature switches may be used in accordance with the present invention, such as canopy switches, double-pole, double throw switches and toggle switches, wherein each switch is manually displaceable between the inactive position and the active position aforementioned, and is readily replaceable or cleaned. According to one specific embodiment of the invention, each switch includes a pivoted contact carrying element that is magnetically held in a raised, inactive position exposing circuit establishing contact terminals on the display surface underlying the contact element in its active position. Magnetic means also releasably holds a zone identifying panel or disc on the pivoted contact element. The contact element is simply displaced manually to a horizontal active position in which it is held by gravity. By manipulating the control board assembly, all actuated switches may be simultaneously displaced to the inactive positions for resetting the control board. According to another embodiment, a multiple circuit switch assembly is associated with each zone so that the player may register selection of the zone with respect to as many as four different circuits. Several games may thereby be played at one time and the space requirement for each switch is reduced.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

FIG. 5 is a partial section view taken substantially through a plane indicated by section line 5—5 in FIG. 4.

FIG. 6 is a partial section view taken substantially through a plane indicated by section line 6—6 in FIG. 5.

FIG. 7 is a simplified electrical circuit diagram corresponding to the circuit associated with the control board assembly shown in FIGS. 1-6.

DETAILED DESCRIPTION OF PREFERRED EMBODIMENT

Figure 1:
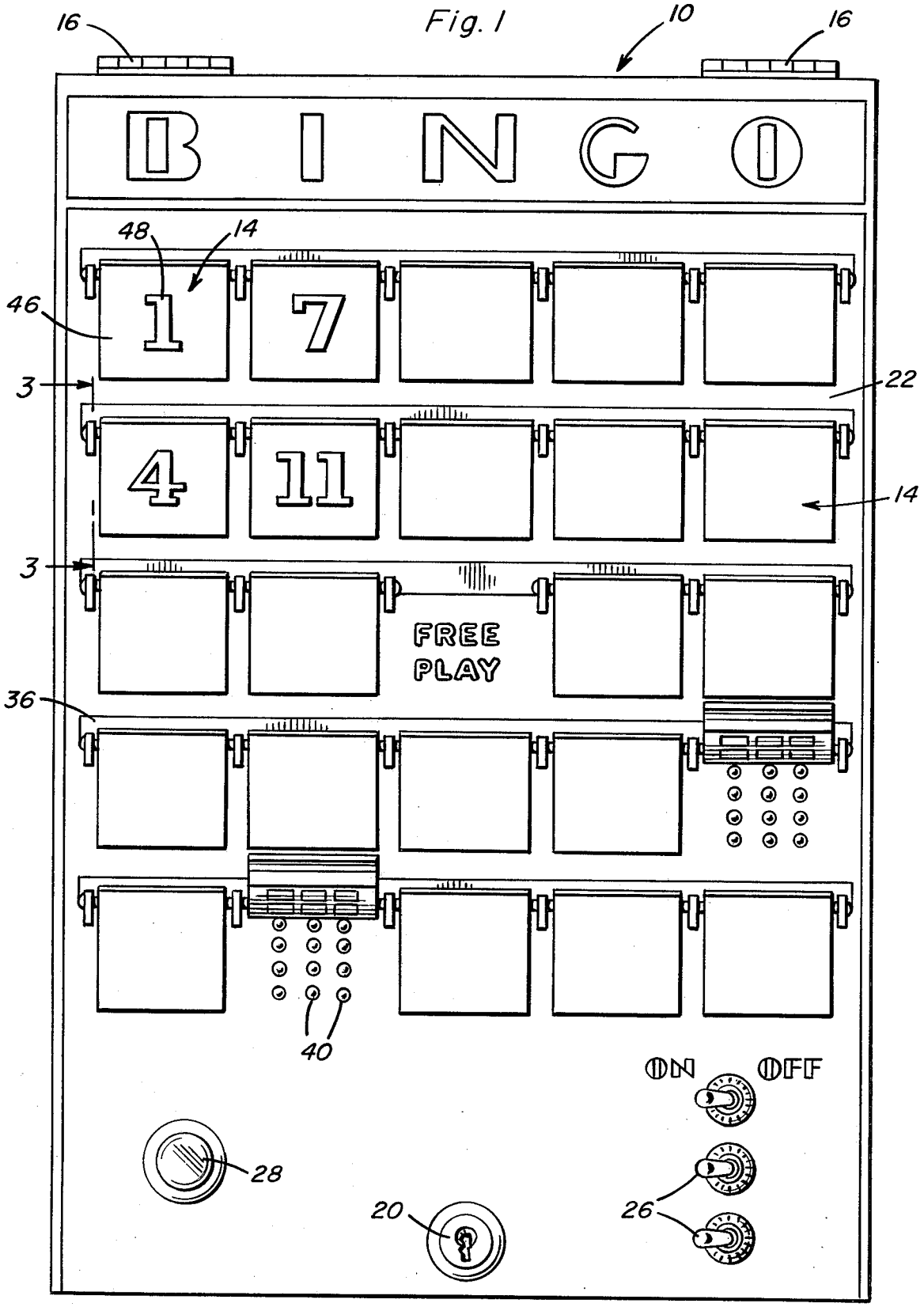
FIG. 1 is a top plan view of a control board assembly constructed in accordance with one embodiment of the invention.
Figure 2:
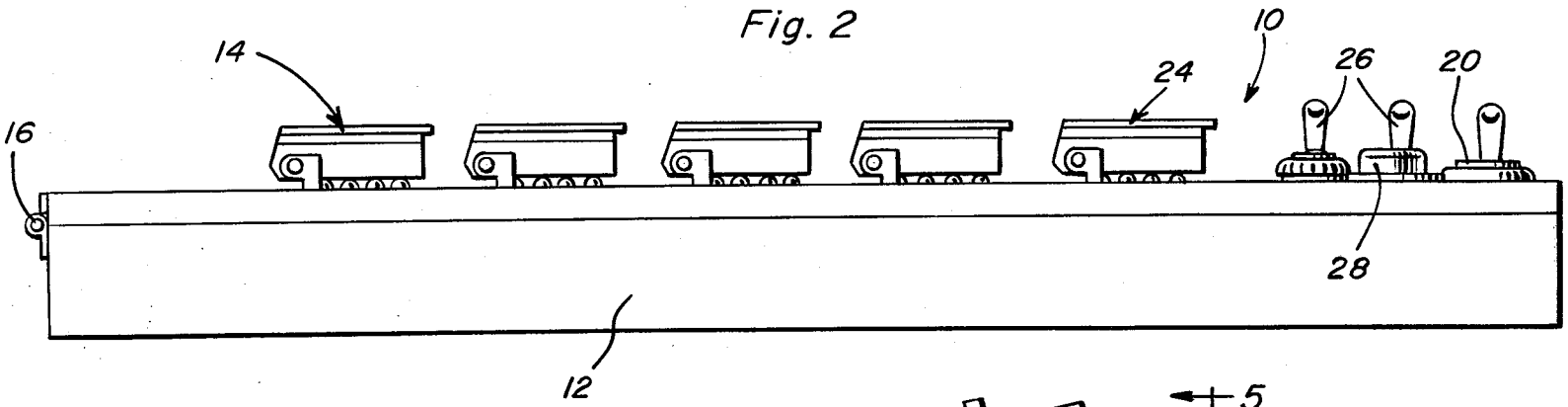
FIG. 2 is a side elevational view of the control board assembly shown in FIG. 1.

Referring now to the drawings in detail, FIGS. 1 and 2 illustrate a game board embodiment of the present invention generally referred to by reference numeral 10.

The assembly 10 includes a generally rectangular housing 12 to which a top display panel 14 is connected by hinges 16. The display panel forms a closure for the housing within which programmed circuitry 18 is enclosed as schematically depicted in FIG. 7 and exposed by pivotal opening of the display panel. The display panel may be held in the closed position on the housing by a lock 20 as shown in FIG. 1.

The display panel 14 in the illustrated embodiment is of the "Bingo" game type as disclosed in my prior copending application aforementioned, and the circuit 18 associated therewith is therefore also similar to the circuit disclosed in the prior copending application. The display panel 14 is divided into a plurality of rectangular zones on the panel surface 22. A manually operable switch device 24 is associated with each zone and wired through the circuit 18 and selection switches 26 to an indicator 28. The selection switches 26 and indicator 28 may be mounted on the display panel as shown. Game winning patterns of actuated zone registering switches 24 are selected through the selector switches 26 to effect operation of the indicator 28 by means of a programmed circuit 18 in a manner disclosed in my prior copending application, aforementioned, the disclosure of which is incorporated herein by reference.

It will be apparent to those skilled in the art that the circuit 18 could be programmed to operate a locking mechanism when the manually operable switches 24 at selected zones are actuated to the active positions in accordance with a security code. The indicator 28 may be energized in response to actuation of switch devices 24 at selected zones as answers to questions when the control board assembly is adapted for educational purposes.

Figure 4:
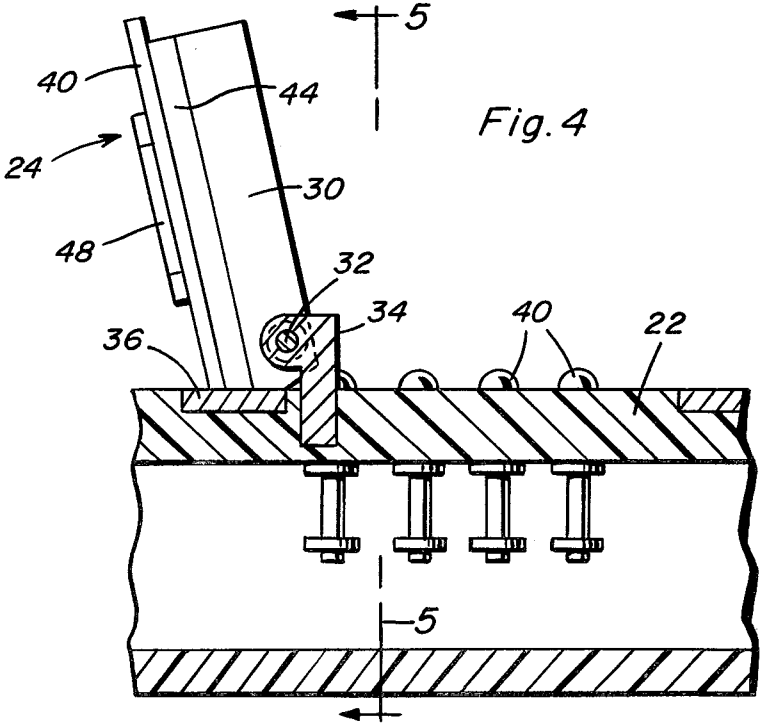
FIG. 4 is a partial section view similar to FIG. 3 showing the switch in an inactive position.

As more clearly seen in FIGS. 3, 4, 5 and 6, each of the switch devices 24 includes a non-conductive, contact-carrying element 30 that is pivotally mounted at its zone by pivot pins 32 extending through pivot supports 34 fixed to the display panel. Metallic holdings bars 36 are embedded in the surface 22 of the display panel extending across each horizontal row of zones so as to be engaged by a rear edge 38 of the contact element 30 in its inactive position as shown in FIG. 4. In the active position of the switch device, the contact element 30 engages a plurality of circuit establishing terminal elements 40 mounted on the display panel and projecting from the surface 22 in underlying relation to the contact element. The terminal elements are bridged by conductive contacts 42 carried on the underside of the contact element as shown in FIGS. 5 and 6.

Figure 3:
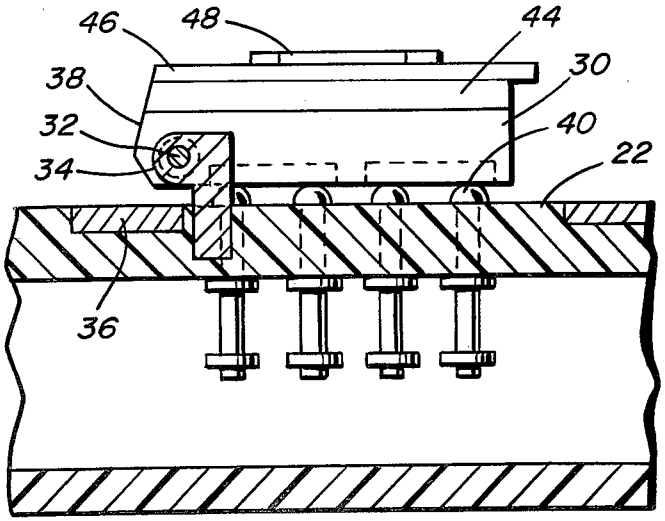
FIG. 3 is an enlarged partial section view taken substantially through a plane indicated by section line 3—3 in FIG. 1 showing one of the switches in an active position.

A permanent magnet 44 is fixed to the contact element as shown in FIGS. 3, 4, and 6 for the two-fold purpose of releasably holding the contact element in the inactive position by contact with bar 36 as shown in FIG. 4, and to releasably hold a metallic zone identifying panel or disc 46 on the top of the contact element. A raised zone identifying symbol 48 is formed on the panel 46 such as a number, a letter or braille so that the zone may be identified by a sight handicapped person by use of the sense of touch. The zone identifying panels 46 may be readily removed and replaced for changing zone identification.

The particular switch devices 24 described are retained in their active positions by the bias of gravity so that all actuated switches may be reset to the inactive positions by simply tilting the control board 10 in one direction. Each switch device in the inactive vertical position of the contact element is simply pushed downwardly to the active position in order to register a zone selection.

Figure 8:
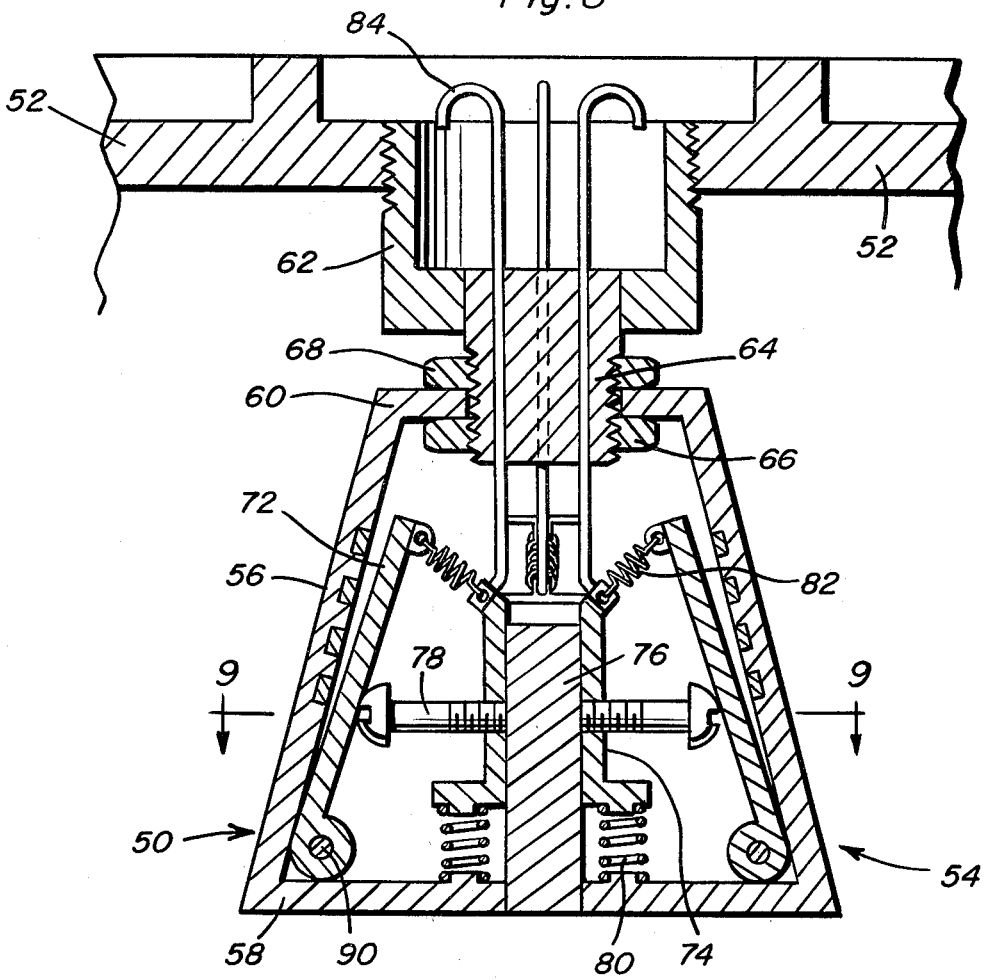
FIG. 8 is a partial section view of a modified form of control board showing a multiple circuit switch assembly in accordance with another embodiment of the invention.
Figure 9:
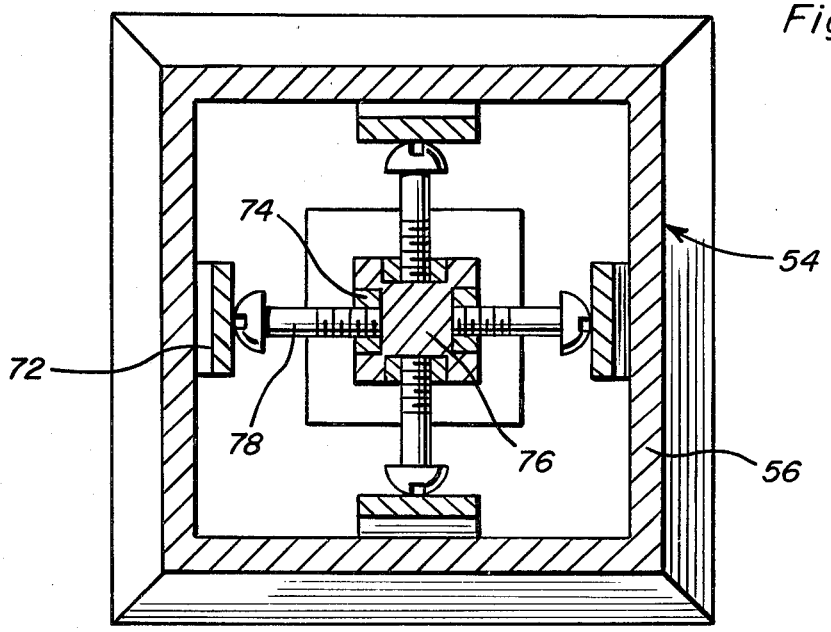
FIG. 9 is a section view taken substantially through a plane indicated by section line 9—9 in FIG. 8.

Referring now to FIGS. 8 and 9, a modified form of control board is shown wherein each of the display panel zones has associated therewith a switch assembly generally referred to by reference numeral 50, mounted in underlying relation to the display panel 52 of the control board. As will become apparent, the area of the zone with which the switch assembly 50 is associated, may be smaller than the zones associated with the manually operated switches 14 hereinbefore described with respect to FIGS. 1 through 6. Further, the switch assembly 50 is completely replaceable and readily disassembled from the display panel 52. Still further, as much as four different programmed circuits may be controlled by each of the switch assemblies 50, thereby enabling a player to change game patterns and play as much as four different games at the same time in a more efficient and rapid manner than was heretofore thought possible.

Each of the switch assemblies 50 includes a switch housing generally referred to by reference numeral 54 having four inclined, contact mounting walls 56 interconnected with a bottom wall 58 and a top wall 60. The switch housing is removably secured in underlying relation to the display panel 52 means of a threaded cap 62 interconnected with the housing by means of a threaded guide element 64. Lock nuts 66 and 68 hold the housing adjustably assembled on the guide element as more clearly seen in FIG. 8.

Pivotally mounted by means of a hinge pin 90 adjacent each of the contact mounting walls 56, is a contact element 72 adapted to be yieldably held in an open or inactive position as shown in FIG. 8. Thus, each of the four contact elements 72 when displaced to an active position engaging its associated contact mounting wall 56, will control a separate programmed circuit.

Each of the contact elements 72 is displaced between its operative positions by means of a vertically slidable element 74 slidably mounted on a guide post 76 that may be fixed within the housing. An adjustable screw arm 78 projects laterally from each vertically slidable element 74 into engagement with an associated contact element 72. Each of the vertically slidable elements 74 is yieldably biased to its lower position as shown by a spring element 80. A spring element 82 interconnects the upper ends of each of the vertically slidable elements 74 with its associated contact element 72 in order to yieldably hold the contact element in its open or inactive position as shown. An actuator rod element 84 is connected to the upper end of each vertical slidable element 74 and extends through the guide element 64 for exposure above the display panel 52 within an area smaller than the contact area on wall 56. It will be apparent that when actuated by an upward pull on a rod element 84, an associated contact element 72 will be frictionally held in contact with a wall 56 by the wedging action of an arm 78. A downward push on an actuated rod element 84 releases the contact element 72 for displacement to the inactive position shown under the bias of springs 82 and 80. Thus, the player may actuated any one or a combination of four contact elements 72 in order to register selection of a zone through one or more programmed circuits. It will thereby be apparent that the player may not only register a selected zone, but may also change the selected pattern that is signified by operation of the indicator associated with the control board.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A programmed control board assembly comprising a display panel divided into a plurality of zones, manually operable means mounted on the display panel at each of said zones for registration of selected zones, changeable means mounted on each of said manually operable means for identifying the zones, means establishing a predetermined pattern formed by groups of said registered zones, means connected to said pattern establishing means for signifying registration of one of said groups of said registered zones, of each of said manually operable means comprising a switch device displaceable between active and inactive positions on the display panel, and magnetic means for releasably holding each of the switch devices in the inactive position, said changeable means comprising a zone identifying panel releasably held on each of the switch devices by the magnetic means.

2. The combination of claim 1 wherein said pattern establishing means is an electrical circuit.

3. The combination of claim 2 wherein each of said switch devices includes a movable contact element displaceable between the active and inactive positions, and terminal means mounted on the display panel for engagement by the movable contact element in the active position.

4. The combination of claim 3 wherein said magnetic releasable holding means includes a magnetic element fixed to the movable contact element.

5. The combination of claim 1 wherein all of said switch devices are gravity displaced to the inactive positions at the same time by manipulation of the display panel, to reset the control board assembly.

6. In a control board assembly, a display panel divided into a plurality of zones, manually operable means displaceable between inactive and active positions at each of said zones for registration of selected ones of the zones, indicator means operatively connected to the manually operable means for signifying registration of a group of the zones in a predetermined pattern, changeable means associated with the manually operable means at each of the zones for changing the predetermined pattern signified by the indicator means, and magnetic means for releasably holding the manually operable means in an inactive position, said changeable means including zone identifying panels releasably held on each of the manually operable means by the magnetic means.

7. In a control board assembly, a display panel divided into a plurality of zones, manually operable means displaceable between inactive and active positions at each of said zones for registration of selected ones of the zones, indicator means operatively connected to the manually operable means for signifying registration of a group of the zones in a predetermined pattern, means cooperating with the manually operable means for holding thereof in the inactive position at each of said zones and changeable means associated with the holding means and the manually operable means at each of the zones for changing the predetermined pattern signified by the indicator means, said changeable means including zone identifying panels releasably held by the holding means on each of the manually operable means.

8. The combination of claim 7 wherein the manually operable means is gravity displaced to the inactive positions by manipulation of the display panel, to reset the control board assembly.

* * * * *